US009327393B1

(12) United States Patent
DePyssler

(10) Patent No.: US 9,327,393 B1
(45) Date of Patent: May 3, 2016

(54) VALVE SPRING COMPRESSION AND VALVE GUIDE SEAL REMOVER SYSTEM

(71) Applicant: Chad DePyssler, Columbia, TN (US)

(72) Inventor: Chad DePyssler, Columbia, TN (US)

( * ) Notice: Subject to any disclaimer, the term of this patent is extended or adjusted under 35 U.S.C. 154(b) by 344 days.

(21) Appl. No.: 13/939,124

(22) Filed: Jul. 10, 2013

Related U.S. Application Data

(60) Provisional application No. 61/676,432, filed on Jul. 27, 2012.

(51) Int. Cl.
*B25B 27/26* (2006.01)
*B25B 27/30* (2006.01)
*B25B 27/24* (2006.01)

(52) U.S. Cl.
CPC ..... *B25B 27/26* (2013.01); *B25B 27/30* (2013.01); *B25B 27/24* (2013.01)

(58) Field of Classification Search
CPC ..... B25B 27/26; B25B 27/24; B25B 27/30
USPC ..... 29/215, 214, 213.1, 218, 219, 220, 221, 29/224, 225
See application file for complete search history.

(56) References Cited

U.S. PATENT DOCUMENTS 1,157,223 A * 10/1915 Holcomb ..... B25B 27/26 254/130
1,340,192 A * 5/1920 Vaughan ..... B25B 27/26 29/220
1,348,570 A * 8/1920 Knight ..... B25B 27/26 29/219
1,370,397 A * 3/1921 Axelton ..... B25B 27/26 29/220
1,501,143 A * 7/1924 Stake ..... B25B 27/26 29/219
1,753,245 A * 4/1930 Neal ..... B25B 27/26 29/220
1,862,948 A * 6/1932 Wainwright ..... B25B 27/26 29/215
1,892,824 A * 1/1933 Ziegler ..... B25B 27/24 29/213.1
2,184,340 A * 12/1939 Ferlin ..... B25B 13/488 7/100
2,316,830 A * 4/1943 Zimmerman ..... B25B 27/26 29/215
2,443,193 A * 6/1948 Necker ..... B25B 27/26 29/219
2,682,387 A * 6/1954 Gaddoni ..... F01L 3/10 251/337
2,940,166 A * 6/1960 Moore ..... B25B 27/26 29/219
3,080,645 A * 3/1963 Moreland ..... B25B 27/26 269/94
3,363,302 A * 1/1968 Haselmo ..... B25B 27/26 29/215
3,413,705 A * 12/1968 Maxwell ..... B25B 27/24 29/213.1

(Continued)

FOREIGN PATENT DOCUMENTS

SU 1600944 A1 * 10/1988
SU 1600944 * 10/1990

OTHER PUBLICATIONS

NUBTOOLS Harley overhead valve spring compressor kit; NUBTOOLS website: http://www.nubtools.com/ 2016.*

*Primary Examiner* — Monica Carter
*Assistant Examiner* — Mahdi H Nejad
(74) *Attorney, Agent, or Firm* — RG Patent Consulting, LLC; Rachel Gilboy

(57) ABSTRACT

A valve spring compression and valve guide seal remover system is a hand tool that is able to grip a valve stem while compressing the valve spring to release and replace the valve stem seals of motorcycle engines without having to remove the head from the engine or the engine from the motorcycle frame.

10 Claims, 5 Drawing Sheets

(56) References Cited

U.S. PATENT DOCUMENTS

| | | | | | |
|---|---|---|---|---|---|
| 3,873,067 | A * | 3/1975 | Carpio | B25B 27/0035 | 254/131 |
| 4,223,431 | A * | 9/1980 | Skeels | B25B 27/26 | 29/219 |
| RE31,520 | E * | 2/1984 | Lightner | B25B 27/023 | 29/217 |
| 4,567,634 | A * | 2/1986 | Landry | B25B 27/26 | 29/220 |
| 5,042,128 | A * | 8/1991 | Barbour | B25B 27/24 | 29/217 |
| 5,241,734 | A * | 9/1993 | Brackett | B25B 27/24 | 29/219 |
| 5,339,515 | A | 8/1994 | Brackett | | |
| 5,349,732 | A * | 9/1994 | Spence | B25B 7/02 | 29/221 |
| 5,507,100 | A * | 4/1996 | Magnet | F01L 1/146 | 123/90.61 |
| 5,689,870 | A * | 11/1997 | Robey | B25B 27/26 | 29/219 |
| 5,966,788 | A | 10/1999 | Klann | | |
| 6,938,315 | B2 | 9/2005 | Alanis | | |
| 7,181,818 | B1 | 2/2007 | Deutscher | | |
| 7,975,357 | B1 | 7/2011 | Irving | | |
| 8,746,052 | B2 * | 6/2014 | Gentner | G01M 15/02 | 73/114.79 |
| 2005/0076486 | A1 * | 4/2005 | Alanis | B25B 27/24 | 29/217 |
| 2011/0226200 | A1 * | 9/2011 | Trease | F01L 1/047 | 123/54.4 |
| 2013/0312687 | A1 * | 11/2013 | Zurface | F01L 1/18 | 123/90.39 |
| 2014/0137406 | A1 * | 5/2014 | Firzlaff | B25B 27/0035 | 29/888.061 |
| 2016/0000481 | A1 * | 1/2016 | Ehmke | A61B 17/80 | 606/71 |

* cited by examiner

VALVE SPRING COMPRESSION AND VALVE GUIDE SEAL REMOVER SYSTEM

CROSS-REFERENCE TO RELATED APPLICATION

The present application is related to and claims priority from prior provisional application Ser. No. 61/676,432, filed Jul. 27, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of valve spring compressors and more specifically relates to a valve spring compression and valve guide seal remover system.

2. Description of the Related Art

On the internal combustion engine, some sort of device is required to allow air that is drawn within the cylinder of the engine block to be compressed. This device is referred to as the head, or the cylinder head. The head generally has multiple functions that have to take place in sequence in order for the engine to work. The head is generally used to allow an intake mixture of air and gasoline to enter the cylinder and to allow combusted air/fuel mixtures to exhaust from the cylinder; this is possible with at least two valves, an intake valve and an exhaust valve. The valves are located in the cylinder head are held closed by springs when they are in a relaxed state. A camshaft with lobes rotates and the high point on the lobes press against the end of the valve stems, which are facing away from the cylinder, to overcome the spring pressure in order to open the valve to either exhaust combusted air/fuel mixture or intake un-combusted air/fuel mixture.

The cylinder head has a flat machined surface that matches a flat machined surface on the engine block. The two are bolted together with a special gasket sandwiched between. Generally, removal of the head is a complicated procedure that incurs the extra cost of machined surface cleanup and a new gasket, along with the numerous other parts, hoses, and or linkages, and a considerable amount of labor. The head is removed when surface machine work or replacement of valves, springs, or valve stem seals are required. Valves must generally be removed from the head to replace any of the parts already mentioned, but the valve will only come out from the bottom side which is the side facing the interior of the cylinder. This is because the underside of the valve is a large flat disk while the side visible from the exterior of the engine is a small diameter shaft that slides through a cylindrical hole in the cylinder head. The removal process is lengthy and expensive and cannot be done while the head is in place on the engine. A process that reduces the amount of labor and time required for replacing valve stem seals or springs is desirable.

Various attempts have been made to solve the above-mentioned problems such as those found in U.S. Pat. Nos. 7,975,357; 7,181,818; 6,938,315; 5,042,128; 5,339,515; and 5,966,788. This art is representative of motorcycle valve spring removal tools and means. None of the above inventions and patents, taken either singly or in combination, is seen to describe the invention as claimed.

Ideally, a motorcycle valve spring removal tool should provide reduced maintenance time and, yet would operate reliably and be manufactured at a modest expense. Thus, a need exists for a reliable valve spring compression and valve guide seal remover system to remove motorcycle valve springs without having to remove the head from the engine, and to avoid the above-mentioned problems.

BRIEF SUMMARY OF THE INVENTION

In view of the foregoing disadvantages inherent in the known motorcycle valve spring removal tool art, the present invention provides a novel valve spring compression and valve guide seal remover system. The general purpose of the present invention, which will be described subsequently in greater detail, is to provide quick replacement of valve stem seals or springs without having to remove the head from the engine.

In a first embodiment, a valve spring compression and valve guide seal remover system may comprise a tool body having a first side, a second side, and a center portion having a plurality of through-holes, and a first end having a first valve orifice and a second end having a second valve orifice. The first end of the tool body is integral with the center portion and is angled toward the second side and the first valve orifice is centrally located within the first end. The plurality of through-holes are arranged in a pattern that are centrally located within the center portion. The second end of the tool body is integral with the center portion and is angled toward the second side and the second valve orifice is centrally located within the second end. The tool body is useful for example for compressing a valve spring of a twin cam motorcycle engine and for removing and replacing a valve guide seal without removing the motor head of a twin cam motorcycle engine to reduce the time span required for repairing the engine.

The tool body in preferred embodiments may comprise a rectangular shape with the first end and the second end of the tool body having about a 30 degree bend toward the second side of the tool body in relation to a planar surface of the first side and the second side of the center portion. The center portion in this embodiment is about 5 inches long and the first end and the second end are each about 1⅝ inches long respectively. The tool body is about ½ inch thick, about 8¾ inches long, and about 2 inches wide such that the tool body is able to fit between the mounting frame and the motorcycle engine without removing the engine from the mounting frame. The pattern of through-holes of the center portion may comprise a triangular shaped pattern having about 5/16 inch holes, but the through-holes may be larger or smaller as needed for various models or manufacture year of engine, and each hole may be of different sizes. The first valve orifice of the first end may have a counter-sunk portion and be of an elongated oval shape. The first valve orifice and the second valve orifice of the first and second ends are each about ¾ inch in width and about 1 inch in length about the inner periphery and the countersunk portion may be about ⅛ inch deep from the surface of the second side.

In a second embodiment, a valve stem seal remover system may comprise a hand tool having a front side and a back side, a center section having a plurality of through-apertures, a left end having a first valve aperture, and a right end having a second valve aperture. The left end of the hand tool is integral with the center section and is angled toward the back side and the first valve aperture is centrally located within the left end. The plurality of though apertures are arranged in a pattern and the pattern of though apertures is centrally located within the center section. The right end of the hand tool is integral with the center section and is angled toward the back side and the second valve aperture is centrally located within the right end. The hand tool is useful for compressing a valve spring of an evolution motorcycle engine and for removing and replacing the valve guide seals without removing the motor head of the evolution motorcycle engine to reduce a time span required for the repair.

The hand tool may comprise a T-shape with the left end and the right end of the hand tool making about a 30 degree bend toward the back side in relation to a planar surface of the front side and the back side of the center section. The first valve aperture of the left end may comprise a counter-sunk portion and may be an elongated oval shape. The second valve aperture of the right end also may also comprise a counter-sunk portion with the second valve aperture forming an elongated oval shape. The first valve aperture and the second valve aperture are each about ¾ inch in width and about 1 inch in length about the inner periphery with the first valve aperture and the second valve aperture countersunk about ⅛ inch. The hand tool is about ½ inch thick, about 8¾ inches long, the left end and the right end about 2 inches wide, and a substantial portion of the center section is about 5 inches wide. The pattern of the plurality of though apertures of the center section may comprise a triangular shape. The center section is about 5 inches long and the left end and the right end are each about 1⅝ inches long respectively.

The valve spring compression and valve guide seal remover system and the valve stem seal remover system are two embodiments of one invention and may comprise a kit having both embodiments in one kit, or each may be sold as an individual kit. The overall length, thickness, diameter of first valve orifice and second valve orifice, diameters of through-holes, degree of bends, diameter of first valve aperture and second valve aperture, diameter of through-apertures, and the materials of construction of the tool body and the hand tool may vary and embody any combination of these variations.

The present invention holds significant improvements and serves as a valve spring compression and valve guide seal remover system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, valve spring compression and valve guide seal remover system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a motorcycle valve spring removal device and more particularly to a valve spring compression and valve guide seal remover system as used to improve the replacement time required for motorcycle engine valve stem seals without having to remove the head from the engine.

Generally speaking, a valve spring compression and valve guide seal remover system is a hand tool that is able to grip a valve stem while compressing the valve spring to release and replace the valve stem seals of motorcycle engines without having to remove the head from the engine or the engine from the motorcycle frame.

Figure 1:
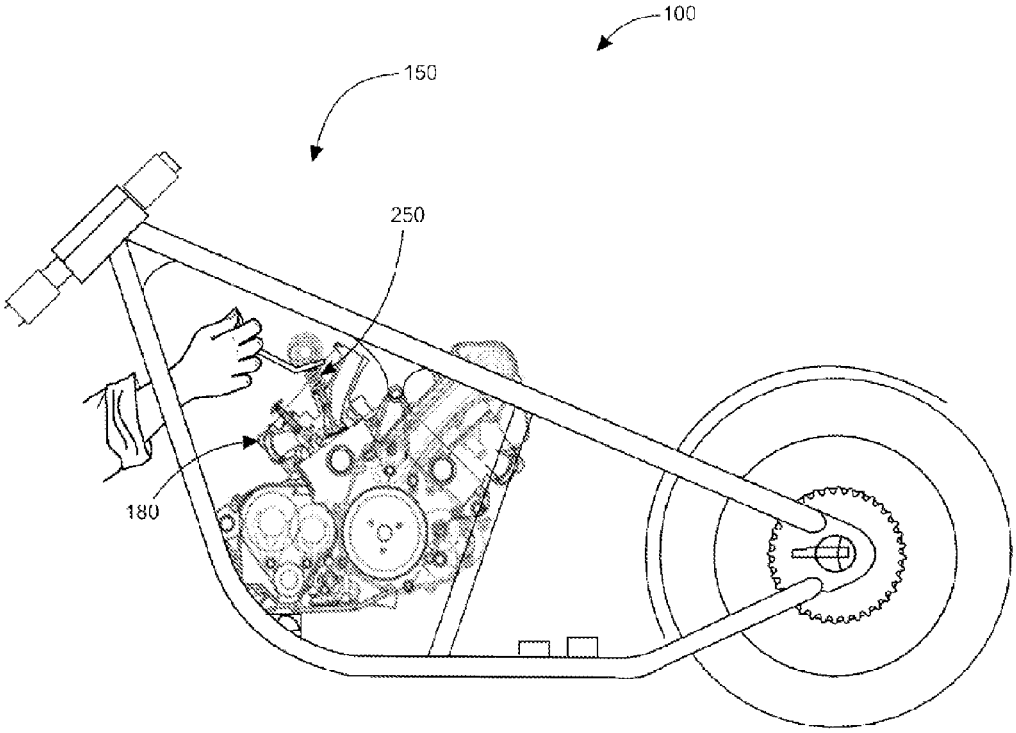
FIG. 1 shows a perspective view illustrating an in-use condition of a valve spring compression and valve guide seal remover system according to an embodiment of the present invention.

Referring to the drawings by numerals of reference there is shown in FIG. 1, a perspective view illustrating an in-use condition of valve spring compression and valve guide seal remover system 100 according to an embodiment of the present invention.

First embodiment of valve spring compression and valve guide seal remover system 100 and the second embodiment of valve stem seal remover system 200 comprise mechanic's tool(s) for compressing valve springs 250 of a twin cam and an evolution motorcycle engine 150 respectively, while holding the stem of the valve and replacing the valve guide seal without removing motor head 180 of motorcycle engine 150 or motorcycle engine 150 from the motorcycle frame to reduce the time span required for replacing valve guide seals or springs. The reduced time required for performing the work results in a flat rate cost savings for the owner's of motorcycles may be realized using the present invention. The device is designed to fit between the top of motorcycle engine 150 and the frame and provides enough leverage to compress valve spring 250 while gripping the valve stem to prevent the valve from falling into the cylinder during the process.

Figure 2:
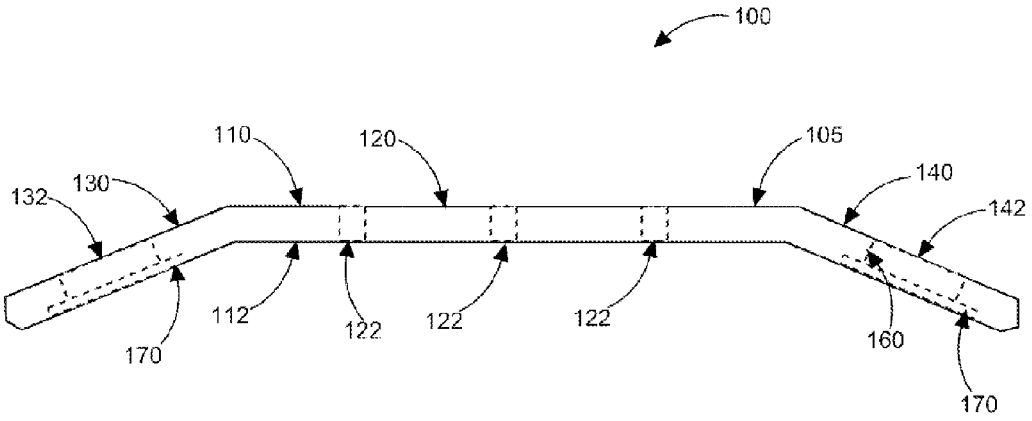
FIG. 2 is a side perspective view illustrating a first embodiment of the valve spring compression and valve guide seal remover system according to an embodiment of the present invention of FIG. 1.

Referring now to FIG. 2, a side perspective view illustrating a first embodiment of valve spring compression and valve guide seal remover system 100 according to an embodiment of the present invention of FIG. 1.

In a first embodiment, valve spring compression and valve guide seal remover system 100 may comprise tool body 105 having first side 110 and second side 112, and center portion 120 having a plurality of through-holes 122, first end 130 having first valve orifice 132 and second end 140 having second valve orifice 142. First end 130 of tool body 105 is integral with center portion 120 and is angled toward second side 112 and first valve orifice 132 is centrally located within first end 130. The plurality of through-holes 122 are arranged in a pattern that are centrally located within center portion 120. Second end 140 of tool body 105 is integral with center portion 120 and is angled toward second side 112 and second valve orifice 142 is centrally located within second end 140.

Figure 3:
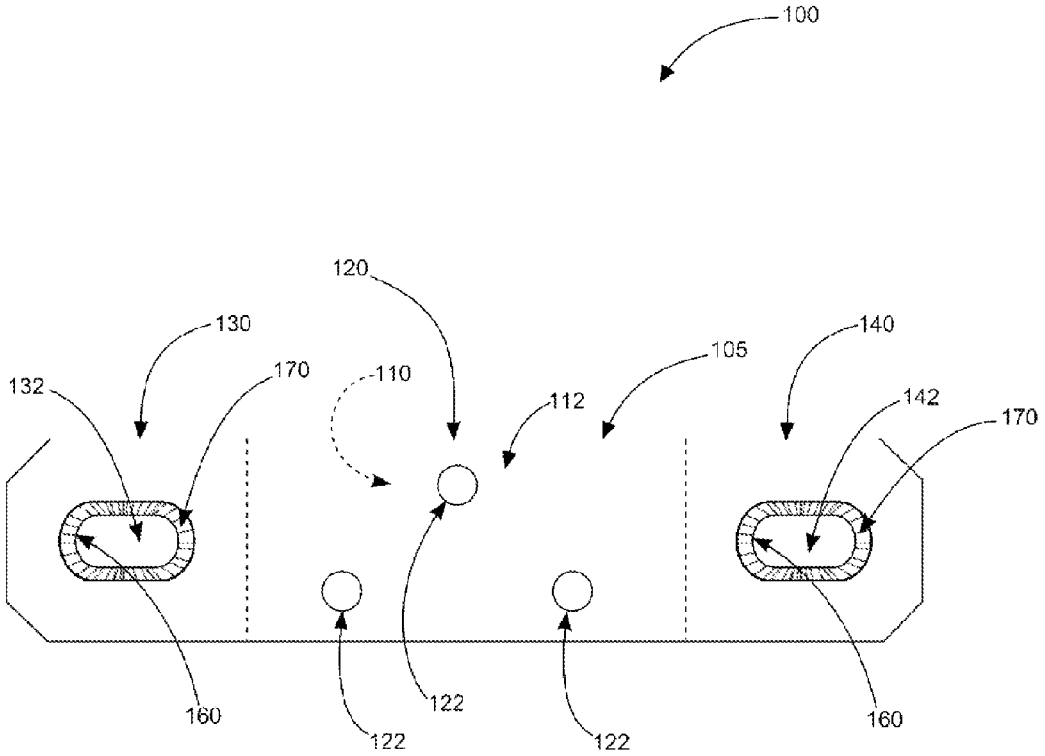
FIG. 3 is a front perspective view illustrating a first embodiment of the valve spring compression and valve guide seal remover system according to an embodiment of the present invention of FIG. 1.

Referring now to FIG. 3, a front perspective view illustrating a first embodiment of valve spring compression and valve guide seal remover system 100 according to an embodiment of the present invention of FIG. 1.

Tool body 105 may comprise a rectangular shape with first end 130 and second end 140 of tool body 105 having about a 30 degree bend toward second side 112 of tool body 105 in relation to a planar surface made by first side 110 and second side 112 of center portion 120. Center portion 120 is about 5 inches long and first end 130 and second end 140 are each about 1⅝ inches long respectively. Tool body 105 is about ½ inch thick, about 8¾ inches long, and about 2 inches wide such that tool body 105 is able to fit between a mounting frame and motorcycle engine 150 without removing motorcycle engine 150 from the mounting frame.

The pattern of through-holes 122 of center portion 120 may comprise a triangular shaped pattern having about 5/16 inch through-holes 122, but through-holes 122 may be larger or smaller as needed for various models or manufacturer year of motorcycle engine 150, and each through-hole 122 may be of different sizes. First valve orifice 132 of first end 130 may have countersunk portion 170 and be of an elongated oval shape. First valve orifice 132 and second valve orifice 142 of first 130 and second end 140 are each about ¾ inch in width and about 1 inch in length about inner periphery 160 and countersunk portion 170 may be about ⅛ inch deep from the surface of second side 112.

Figure 4:
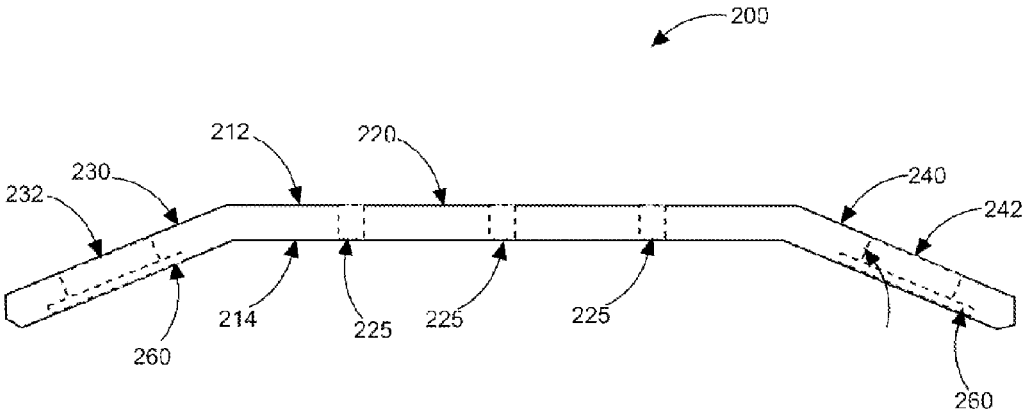
FIG. 4 is a side perspective view illustrating a second embodiment of a valve stem seal remover system according to an embodiment of the present invention of FIG. 1.

Referring now to FIG. 4, a side perspective view illustrating a second embodiment of valve stem seal remover system 200 according to an embodiment of the present invention of FIG. 1.

In a second embodiment, valve stem seal remover system 200 may comprise hand tool 210 having front side 212 and back side 214, center section 220 having a plurality of through-apertures 225, left end 230 having first valve aperture 232, and right end 240 having second valve aperture 242. Left end 230 of hand tool 210 is integral with center section 220 and is angled toward back side 214 and first valve aperture 232 is centrally located within left end 230. The plurality of through-apertures 225 are arranged in a pattern and the pattern of through-apertures 225 is centrally located within center section 220. Right end 240 of hand tool 210 is integral with center section 220 and is angled toward back side 214 and second valve aperture 242 is centrally located within right end 240. Hand tool 210 is useful for compressing valve spring 250 of an evolution motorcycle engine 150 and for removing and replacing valve guide seals without removing motor head 180 of evolution motorcycle engine 150 to reduce the time span required for a repair.

Figure 5:
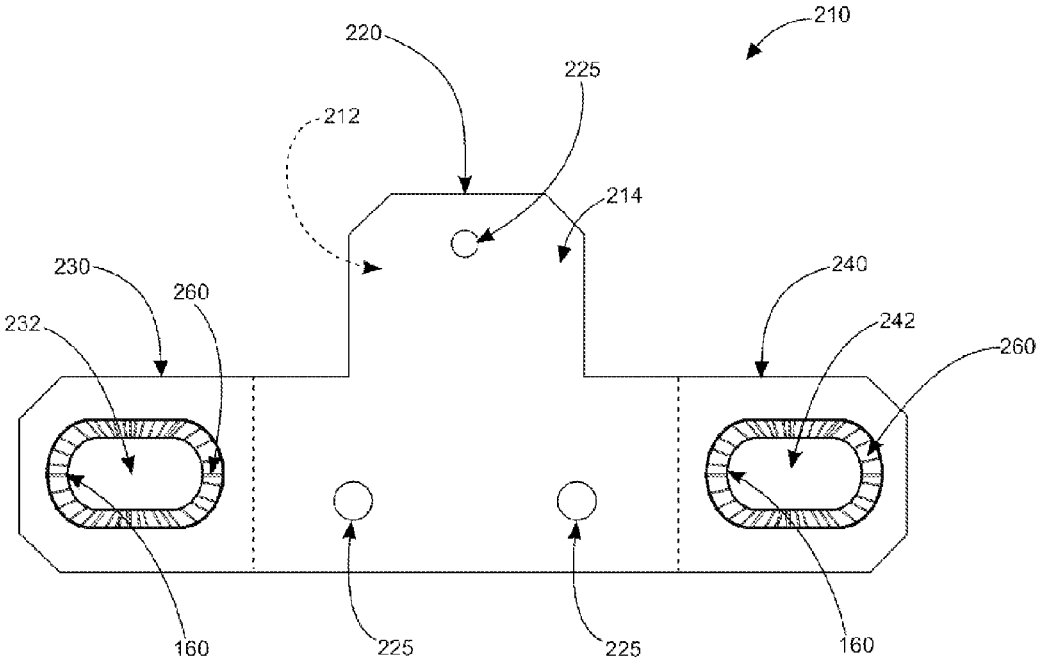
FIG. 5 is a front perspective view illustrating a second embodiment of a valve stem seal remover system according to an embodiment of the present invention of FIG. 1.

Referring now to FIG. 5, a front perspective view illustrating a second embodiment of a valve stem seal remover system 200 according to an embodiment of the present invention of FIG. 1.

Hand tool 210 may comprise a T-shape with left end 230 and right end 240 of hand tool 210 making about a 30 degree bend toward back side 214 in relation to a planar surface of front side 212 and back side 214 of center section 220. First valve aperture 232 of left end 230 may comprise counter-sunk portion 260 and may be an elongated oval shape. Second valve aperture 242 of right end 240 also may comprise counter-sunk portion 260 with second valve aperture 242 forming an elongated oval shape. First valve aperture 232 and second valve aperture 242 is each about ¾ inches in width and about 1 inch in length about inner periphery 160 with first valve aperture 232 and second valve aperture 242 countersunk about ⅛ inch. Hand tool 210 is about ½ inch thick, about 8¾ inches long, left end 230 and right end 240 are about 2 inches wide, and a substantial portion of center section 220 is about 5 inches wide. The pattern of through-apertures 225 of center section 220 may comprise a triangular shape. Center section 220 is about 5 inches long and left end 230 and right end 240 are each about 1⅝ inches long respectively.

Valve spring compression and valve guide seal remover system 100 and valve stem seal remover system 200 are two embodiments of one invention and may comprise a kit having both embodiments in one kit, or each may be sold as an individual kit. A kit may comprise hand tool 210 of valve stem seal remover system 200, a kit may contain tool body 105 of valve spring compression and valve guide seal remover system 100, or a kit may contain both. The overall length, thickness, diameter of first valve orifice 132 and second valve orifice 142, diameters of through-holes 122, degree of bends, diameter of first valve aperture 232 and second valve aperture 242, diameter of through-apertures 225, and the materials of construction of tool body 105 and hand tool 210 may vary and embody any combination of these variations. A method of use may comprise use of the tool as described above while the motor is yet still in the frame.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A valve spring compression and valve guide seal remover system comprising:
- a tool body comprising;
  - a first side and a second side;
  - a center portion having;
    - a plurality of through-holes;
      - wherein said plurality of through-holes are located on said center portion such that they form a pattern having a triangular shape, and adapted as such to be used on a motor having valve springs located with a geometry to one another that is the same as the geometry between said plurality of said through-holes;
  - a first end having;
    - a first valve orifice; and
  - a second end having;
    - a second valve orifice;
- wherein said first end of said tool body is integral with said center portion and is angled toward said second side;
- wherein said first valve orifice is centrally located within said first end;

wherein said second end of said tool body is integral with said center portion and is angled toward said second side;

wherein said second valve orifice is centrally located within said second end; and wherein said tool body is useful for compressing a plurality of valve springs of a twin cam motorcycle engine at the same time, and for removing and replacing a valve guide seal without removing a motor head of said twin cam motorcycle engine to reduce a time span required for a repair of said twin cam motorcycle engine.

2. The valve spring compression and valve guide seal remover system of claim 1 wherein said tool body comprises a rectangular shape, and said first end and said second end of said tool body comprise about a 30 degree bend toward said second side in relation to a planar surface of said first side and said second side of said center portion.

3. The valve spring compression and valve guide seal remover system of claim 1 wherein said first valve orifice of said first end comprises a counter-sunk portion.

4. The valve spring compression and valve guide seal remover system of claim 3 wherein said first valve orifice comprises an elongated oval shape.

5. The valve spring compression and valve guide seal remover system of claim 1 wherein said second valve orifice of said second end comprises a counter-sunk portion.

6. The valve spring compression and valve guide seal remover system of claim 5 wherein said second valve orifice comprises an elongated oval shape.

7. The valve spring compression and valve guide seal remover system of claim 2 wherein said tool body is about ½ inch thick, about 8¾ inches long, and about 2 inches wide such that said tool body is able to fit between a mounting frame and a motorcycle engine without removing said engine from said mounting frame.

8. The valve spring compression and valve guide seal remover system of claim 2 wherein said center portion is about 5 inches long and said first end and said second end are each about 1⅝ inches long respectively.

9. The valve spring compression and valve guide seal remover system of claim 1 wherein said first valve orifice and said second valve orifice are each about ¾ inch in width and about 1 inch in length about an inner periphery and is countersunk about ⅛ inch.

10. The valve guide seal remover system of claim 1 wherein said hand tool comprises a T-shape, and said left end and said right end of said hand tool comprise about a 30 degree bend toward said back side in relation to a planar surface of said front side and said back side of said center section; and wherein said T-shape is formed by a portion of said center portion being elongated in a direction perpendicular to a length of said hand tool between said first and second sides; and wherein two of said through-holes are located on said center portion in between said first and second sides, and a third of said through-holes is located on said elongated portion and spaced a distance from said two through-holes located on said center portion in between said first and second sides, such that said hand tool is adapted to be used on a motor having valve springs located with a geometry to one another that is the same as the geometry between said three through-holes on said T-shape.

* * * * *